US007748141B2

(12) United States Patent
Smith et al.

(10) Patent No.: US 7,748,141 B2
(45) Date of Patent: Jul. 6, 2010

(54) ARTICLE OF FOOTWEAR WITH SUPPORT ASSEMBLIES HAVING ELASTOMERIC SUPPORT COLUMNS

(75) Inventors: Steven F. Smith, Beaverton, OR (US); Gerald Edwin Crowley, Beaverton, OR (US); Christopher Cook, Beaverton, OR (US)

(73) Assignee: NIKE, Inc, Beaverton, OR (US)

( * ) Notice: Subject to any disclaimer, the term of this patent is extended or adjusted under 35 U.S.C. 154(b) by 1051 days.

(21) Appl. No.: 11/419,015

(22) Filed: May 18, 2006

(65) Prior Publication Data

US 2007/0266592 A1 Nov. 22, 2007

(51) Int. Cl.
*A43B 13/18* (2006.01)
*A43B 13/20* (2006.01)

(52) U.S. Cl. ..... 36/28; 36/29

(58) Field of Classification Search ..... 36/28, 36/29, 27, 102, 103, 30 R, 31, 37, 35 R
See application file for complete search history.

(56) References Cited

U.S. PATENT DOCUMENTS

| | | | |
|---|---|---|---|
| 507,490 | A | 10/1893 | Gambino |
| 607,086 | A | 7/1898 | Safford |
| 622,673 | A | 4/1899 | Ferrata |
| 933,422 | A | 9/1909 | Dee |
| 949,754 | A | 2/1910 | Busky |
| 1,094,211 | A | 4/1914 | Jenoi et al. |
| 1,099,180 | A | 6/1914 | Karacsonyi |
| 1,102,343 | A | 7/1914 | Kovacs |
| 1,272,490 | A | 7/1918 | Matear |
| 1,278,320 | A | 9/1918 | Ellithorpe |
| 1,338,817 | A | 5/1920 | DeLuca |
| 1,502,087 | A | 7/1924 | Bunns |
| 1,670,747 | A | 5/1928 | Sestito |
| 1,870,065 | A | 8/1932 | Nusser |
| 1,870,114 | A | 8/1932 | Heller |
| 2,104,924 | A | 1/1938 | Dellea |
| 2,122,108 | A | 6/1938 | Modlin |
| 2,198,228 | A | 4/1940 | Pinaud et al. |
| 2,299,009 | A | 10/1942 | Denk |

(Continued)

FOREIGN PATENT DOCUMENTS

| | | |
|---|---|---|
| CH | 570130 | 12/1975 |

(Continued)

OTHER PUBLICATIONS

Article entitled "Hoop Dreams" (Applicant does not know the date of publication; however, it is believed that the publication date for this reference is at least one year prior to May 18, 2006 filing date for the present application), 1 Page.

(Continued)

*Primary Examiner*—Jila M Mohandesi
(74) *Attorney, Agent, or Firm*—Banner & Witcoff, Ltd.

(57) ABSTRACT

An article of footwear includes an upper and a sole assembly secured to the upper. The sole assembly has an upper plate and a plurality of support assemblies. Each support assembly includes a web spaced from the upper plate and a plurality of elastomeric support columns extending between the upper plate and the web. An outsole is secured to at least one of the support assemblies.

24 Claims, 1 Drawing Sheet

U.S. PATENT DOCUMENTS

| | | | |
|---|---|---|---|
| 2,437,227 | A | 3/1948 | Hall |
| 2,710,460 | A | 6/1955 | Stasinos |
| 2,721,400 | A | 10/1955 | Israel |
| 3,041,746 | A | 7/1962 | Rakus |
| 3,429,545 | A | 2/1969 | Michel |
| 3,822,490 | A | 7/1974 | Murawski |
| 4,000,566 | A | 1/1977 | Famolare, Jr. |
| 4,030,213 | A | 6/1977 | Daswick |
| 4,074,446 | A | 2/1978 | Eisenberg |
| 4,223,457 | A | 9/1980 | Borgeas |
| 4,237,625 | A | 12/1980 | Cole et al. |
| 4,241,523 | A | 12/1980 | Daswick |
| 4,262,433 | A | 4/1981 | Hagg et al. |
| 4,267,648 | A | 5/1981 | Weisz |
| 4,271,606 | A | 6/1981 | Rudy |
| 4,314,413 | A | 2/1982 | Dassler |
| 4,319,412 | A | 3/1982 | Muller et al. |
| 4,322,893 | A | 4/1982 | Halvorsen |
| 4,342,158 | A | 8/1982 | McMahon et al. |
| 4,364,188 | A | 12/1982 | Turner |
| 4,399,621 | A | 8/1983 | Dassler |
| 4,439,936 | A | 4/1984 | Clarke et al. |
| 4,492,046 | A | 1/1985 | Kosova |
| 4,494,321 | A | 1/1985 | Lawlor |
| 4,535,553 | A | 8/1985 | Derderian et al. |
| 4,536,974 | A | 8/1985 | Cohen |
| 4,546,555 | A | 10/1985 | Spademan |
| 4,559,366 | A | 12/1985 | Hostettler |
| 4,566,206 | A | 1/1986 | Weber |
| 4,592,153 | A | 6/1986 | Jacinto |
| 4,594,799 | A | 6/1986 | Lin |
| 4,598,484 | A | 7/1986 | Ma |
| 4,598,487 | A | 7/1986 | Misevich |
| 4,610,099 | A | 9/1986 | Signori |
| 4,616,431 | A | 10/1986 | Dassler |
| 4,624,062 | A | 11/1986 | Autry |
| 4,638,575 | A | 1/1987 | Illustrato |
| 4,638,577 | A | 1/1987 | Riggs |
| 4,660,299 | A | 4/1987 | Omilusik |
| 4,680,875 | A | 7/1987 | Danieli |
| 4,680,876 | A | 7/1987 | Peng |
| 4,709,489 | A | 12/1987 | Welter |
| 4,715,130 | A | 12/1987 | Scatena |
| 4,722,131 | A | 2/1988 | Huang |
| 4,731,939 | A | 3/1988 | Parracho et al. |
| 4,733,483 | A | 3/1988 | Lin |
| 4,746,555 | A | 5/1988 | Luckanuck |
| 4,753,021 | A | 6/1988 | Cohen |
| 4,774,774 | A | 10/1988 | Allen, Jr. |
| D298,583 | S | 11/1988 | Yung-Mao |
| 4,794,707 | A | 1/1989 | Franklin et al. |
| 4,798,009 | A | 1/1989 | Colonel et al. |
| 4,802,289 | A | 2/1989 | Guldager |
| 4,815,221 | A | 3/1989 | Diaz |
| 4,843,737 | A | 7/1989 | Vorderer |
| 4,843,741 | A | 7/1989 | Yung-Mao |
| 4,878,300 | A | 11/1989 | Bogaty |
| 4,881,328 | A | 11/1989 | Yung-Mao |
| 4,881,329 | A | 11/1989 | Crowley |
| 4,887,367 | A | 12/1989 | Mackness et al. |
| 4,905,382 | A | 3/1990 | Yung-Mao |
| 4,908,962 | A | 3/1990 | Yung-Mao |
| 4,910,884 | A | 3/1990 | Lindh et al. |
| 4,918,838 | A | 4/1990 | Chang |
| 4,936,029 | A | 6/1990 | Rudy |
| 4,956,927 | A | 9/1990 | Misevich et al. |
| 4,984,376 | A | 1/1991 | Walter et al. |
| D315,634 | S | 3/1991 | Yung-Mao |
| 5,005,300 | A | 4/1991 | Diaz et al. |
| 5,014,449 | A | 5/1991 | Richard et al. |
| 5,068,981 | A | 12/1991 | Jung |
| 5,092,060 | A | 3/1992 | Frachey et al. |
| 5,138,776 | A | 8/1992 | Levin |
| 5,222,312 | A | 6/1993 | Doyle |
| 5,233,767 | A | 8/1993 | Kramer |
| 5,343,639 | A | 9/1994 | Kilgore et al. |
| 5,353,523 | A | 10/1994 | Kilgore et al. |
| 5,572,804 | A | 11/1996 | Skaja et al. |
| 5,685,090 | A | 11/1997 | Tawney et al. |
| 5,782,014 | A | 7/1998 | Peterson |
| 5,853,844 | A | 12/1998 | Wen |
| 5,976,451 | A | 11/1999 | Skaja et al. |
| 6,018,889 | A | 2/2000 | Friton |
| 6,055,747 | A | 5/2000 | Lombardino |
| 6,115,944 | A | 9/2000 | Lain |
| 6,131,310 | A | 10/2000 | Fang |
| D433,216 | S | 11/2000 | Avar et al. |
| 6,233,846 | B1 | 5/2001 | Sordi |
| 6,305,100 | B1 | 10/2001 | Komarnycky et al. |
| 6,457,261 | B1 | 10/2002 | Crary |
| 2002/0189134 | A1 | 12/2002 | Dixon |
| 2004/0221483 | A1 | 11/2004 | Cartier et al. |

FOREIGN PATENT DOCUMENTS

| | | | |
|---|---|---|---|
| DE | 806647 | | 5/1952 |
| DE | 1485654 | | 3/1970 |
| DE | 3400997 | | 7/1985 |
| EP | 1386553 | A1 | 2/2004 |
| ES | 2080933 | | 2/1996 |
| ES | 1036287 | | 7/1997 |
| FR | 465267 | | 4/1914 |
| FR | 1227420 | | 8/1960 |
| FR | 2556188 | A | 6/1985 |
| GB | 21594 | | 8/1903 |
| GB | 7163 | | 3/1907 |
| GB | 2032761 | A | 5/1980 |
| GB | 2173987 | A | 10/1986 |
| JP | 146188 | | 11/1990 |
| SU | 1526637 | A1 | 7/1989 |
| WO | 9520333 | | 1/1995 |

OTHER PUBLICATIONS

Advertisement for Aura "Introducing the exciting new performance driven 2001 Aura", 1 Page.

Web page translation using babelfish, entitled "The tennis shoe with the Motivating Force" (Applicant does not know the date of publication; however, it is believed that the publication date for this reference is at least one year prior to May 18, 2006 filing date for the present application), 2 Pages.

FWN, vol. 46, No. 38, Sep. 17, 1990, "Marco Scatena puts sprint in Athlon wearers' control," 1 Page.

Spring-and Shock Absorber Bearing Spring Elements Springing Comfort with High Damping (Applicant does not know the date of publication; however, it is believed that the publication date for this reference is at least one year prior to May 18, 2006 filing date for the present application), 3 Pages.

Activ Power Spring System catalog, front and back pages with English translation of back page, 3 Pages.

Search Report -PCT/US2007/067973 dated Oct. 18, 2007.

US 4,974,345, 12/1990, Yung-Mao (withdrawn)

ARTICLE OF FOOTWEAR WITH SUPPORT ASSEMBLIES HAVING ELASTOMERIC SUPPORT COLUMNS

FIELD OF THE INVENTION

This invention relates generally to footwear, and, in particular, to an article of footwear with a plurality of support assemblies having elastomeric support columns.

BACKGROUND OF THE INVENTION

A conventional article of athletic footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces (i.e., imparting cushioning), the sole structure may provide traction and control foot motions, such as pronation. Accordingly, the upper and the sole structure operate cooperatively to provide a comfortable structure that is suited for a variety of ambulatory activities, such as walking and running.

The sole structure of athletic footwear generally exhibits a layered configuration that may include a comfort-enhancing insole, a resilient midsole formed from a polymer foam material, and a ground-contacting outsole that provides both abrasion-resistance and traction. The midsole is the primary sole structure element that imparts cushioning and controls foot motions. Suitable polymer foam materials for the midsole include ethylvinylacetate or polyurethane, which compress resiliently under an applied load to attenuate ground reaction forces created by the impacts of running and jumping. Conventional polymer foam materials are resiliently compressible, in part, due to the inclusion of a plurality of open or closed cells that define an inner volume substantially displaced by gas. The polymer foam materials of the midsole may also absorb energy when compressed during ambulatory activities. The compression of the foam is affected by hysteresis loss, and deflection of such systems is affected by the volume of the compressed mass of the midsole.

It would be desirable to provide an article of footwear that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide an article of footwear having support assemblies with elastomeric support columns. In accordance with a first aspect, an article of footwear includes an upper and a sole assembly secured to the upper. The sole assembly has an upper plate and a plurality of support assemblies. Each support assembly includes a web spaced from the upper plate and a plurality of elastomeric support columns extending between the upper plate and the web. An outsole is secured to at least one of the support assemblies.

In accordance with another aspect, an article of footwear includes an upper and a sole assembly secured to the upper. The sole assembly includes an upper plate and a plurality of support assemblies. Each support assembly includes a web spaced from the upper plate and a plurality of elastomeric support columns extending between the upper plate and the web. Each support assembly is spaced from other adjacent support assemblies by a gap. An outsole is secured to at least one of the support assemblies.

In accordance with a further aspect, an article of footwear includes an upper and a sole assembly secured to the upper. The sole assembly includes an upper plate and a heel support assembly. A midfoot support assembly is spaced forwardly from the heel support assembly. A lateral support assembly is spaced forwardly from the midfoot support assembly on a lateral side of the footwear. A medial support assembly is spaced forwardly from the midfoot support assembly on a medial side of the footwear. A forefoot support assembly is spaced forwardly of the lateral and medial support assemblies. Each support assembly includes a web spaced from the upper plate and a plurality of support columns extending between the upper plate and the web. An outsole is secured to the heel support assembly.

Substantial advantage is achieved by providing an article of footwear having support assemblies with elastomeric support columns. In particular, certain embodiments of the footwear can have portions therein optimized to provide desired ground reaction attenuation forces and desired stability. These and additional features and advantages disclosed here will be further understood from the following detailed disclosure of certain embodiments.

Figure 1:
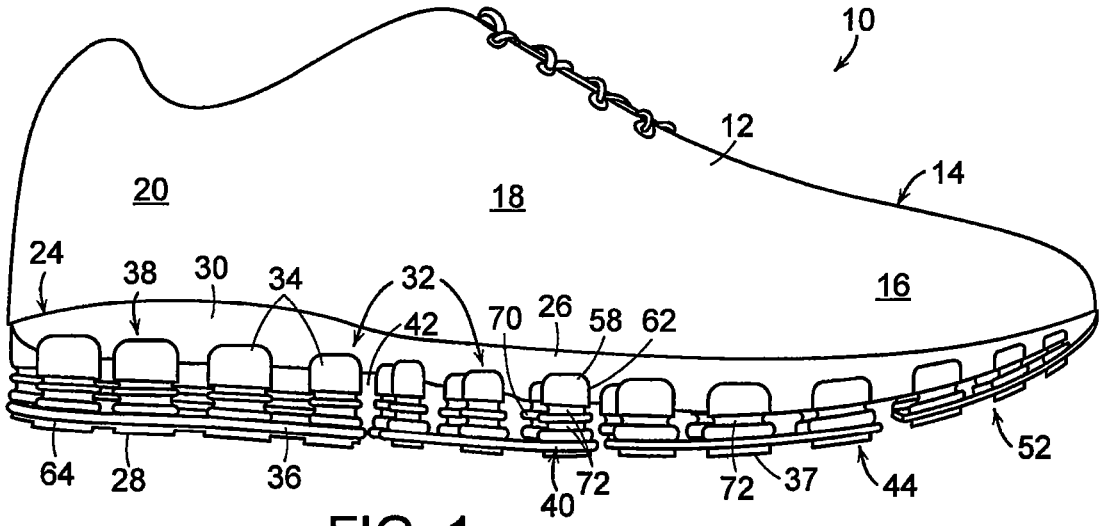
FIG. 1 is an elevation view of an article of footwear having a plurality of support assemblies with elastomeric support columns.

The figures referred to above are not drawn necessarily to scale and should be understood to provide a representation of the invention, illustrative of the principles involved. Some features of the article of footwear depicted in the drawings have been enlarged or distorted relative to others to facilitate explanation and understanding. The same reference numbers are used in the drawings for similar or identical components and features shown in various alternative embodiments. Articles of footwear as disclosed herein would have configurations and components determined, in part, by the intended application and environment in which they are used.

DETAILED DESCRIPTION OF CERTAIN PREFERRED EMBODIMENTS

Figure 2:
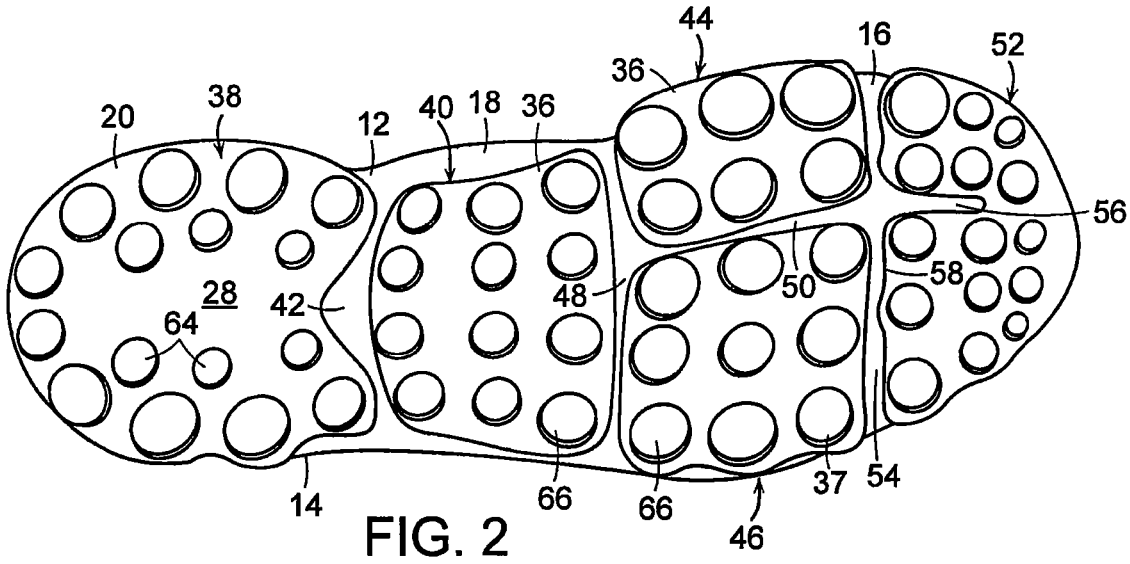
FIG. 2 is a plan view of the sole of the article of footwear of FIG. 1, illustrating a plurality of support assemblies, with each support assembly including a plurality of elastomeric support columns extending between an upper plate and a web.
Figure 3:
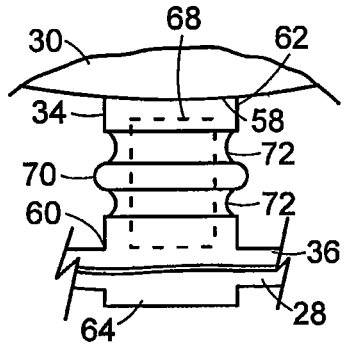
FIG. 3 is an elevation view of an elastomeric support column of the article of footwear of FIG. 1.

The present invention may be embodied in various forms. A preferred embodiment of an article of footwear 10 is shown in FIGS. 1-3. Footwear 10 has a medial, or inner, side 12 and a lateral, or outer, side 14. For purposes of general reference, footwear 10 may be divided into three general portions: a forefoot portion 16, a midfoot portion 18, and a heel portion 20. Portions 16, 18, and 20 are not intended to demarcate precise areas of footwear 10. Rather, portions 16, 18, and 20 are intended to represent general areas of footwear 10 that provide a frame of reference during the following discussion. The figures illustrate only the article of footwear intended for use on the left foot of a wearer. One skilled in the art will recognize that a right article of footwear, such article being the mirror image of the left, is intended to fall within the scope of the present invention.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the left as seen in FIG. 1. Naturally, forwardly is toward forefoot portion 16, that is, to the right as seen in FIG. 1, and downwardly is toward the bottom of the page as seen in FIG. 1. Inwardly is toward the center of footwear 10, and outwardly is toward the outer peripheral edge of footwear 10.

Footwear 10 includes an upper 22, and a sole assembly 24 secured to upper 22. Sole assembly 24 may be secured to upper 22 by an adhesive, or any other suitable fastening means. Upper 22 receives and comfortably secures footwear 10 to a foot of a wearer. Sole assembly 24, which is generally disposed between the foot of the wearer and the ground, provides attenuation of ground reaction forces (i.e., imparting cushioning), traction, and may control foot motions, such as pronation. As with conventional articles of footwear, sole assembly 24 may include an insole (not shown) located within upper 22, a midsole 26, and an outsole 28. Midsole 26 is attached to upper 22 and functions as the primary shock-attenuating and energy-absorbing component of footwear 10. Suitable materials for outsole 22 include traditional rubber materials. Other suitable materials for outsole 28 will become readily apparent to those skilled in the art, given the benefit of this disclosure. In certain embodiments, sole assembly 24 may not include an outsole layer separate from midsole 26 but, rather, the outsole may comprise a bottom surface of midsole 26 that provides the external traction surface of sole assembly 24.

Midsole 26 includes a top plate 30 secured to upper 22 by adhesive or any other suitable fastening means. Top plate 30 may be formed of a polymer, e.g., a polyether-block copolyamide polymer (sold as Pebax® by ATOFINA Chemicals of Philadelphia, Pa.), nylon resins such as Zytel®, sold by Dupont, or polyurethane, for example. Other suitable materials for top plate 30 will become readily apparent to those skilled in the art, given the benefit of this disclosure.

Midsole 26 is formed of a plurality of support assemblies 32. Each support assembly 32 includes a plurality of compressible elastomeric support columns 34 extending between top plate 30 and a web 36. Suitable materials for support columns 34 and web 36 include rubber, polyurethane foam, microcellular elastomeric foams, or ethyl vinyl acetate (EVA) foam. Other suitable materials for support columns 34 will become readily apparent to those skilled in the art, given the benefit of this disclosure.

In the illustrated embodiment, a rear support assembly 38 is provided in heel portion 20 of footwear 10. A midfoot support assembly 40 is spaced forwardly of rear support assembly 38, with a first transverse gap 42 extending between rear support assembly 38 and midfoot support assembly 40. A medial support assembly 44 is positioned forwardly of midfoot support assembly 40 on medial side 12 of a rear of forefoot portion 16 of footwear 10. A lateral support assembly 46 is also positioned forwardly of midfoot support assembly 40 on lateral side 14 of the rear of forefoot portion 16. Medial support assembly 44 and lateral support assembly 46 are spaced from midfoot support by a second transverse gap 48. Medial support assembly 44 and lateral support assembly 46 are spaced from one another by a longitudinal gap 50.

A forefoot support assembly 52 is positioned in a front area of forefoot portion 16 of footwear 10, and is spaced forwardly from medial support assembly 44 and lateral support assembly 46 by a third transverse gap 54. A slit 56 extends forwardly from a rear edge 58 into a central portion of forefoot support assembly 52.

Although the illustrated embodiment shows midsole 26 having five (5) support assemblies, it is to be appreciated that any number of support assemblies can be provided in sole assembly 24, in any desired locations. Providing distinct support assemblies, spaced from one another by a gap, allows particular regions of footwear 10 to be tuned to have desired performance and comfort characteristics.

In the illustrated embodiment, outsole 28 comprises individual pieces, each being secured to a lower surface of web 36. In certain embodiments, only certain support assemblies include an outsole 28, while other support assemblies do not include a separate outsole component; rather, the support assembly itself provides the ground-contacting surface.

For example, as illustrated in FIGS. 1-2, only rear support assembly 38 includes has an outsole 28. Midfoot support assembly 40, medial support assembly 44, lateral support assembly 46 and forefoot assembly 52 have no separate outsole component, and these support assemblies themselves provide the ground-contacting surface.

Each support column 34 includes an upper surface 58 that is attached to top plate 30, a lower surface 60 that is attached to web 36, and an exposed exterior surface 62 that extends between upper surface 58 and lower surface 60. Upper surface 58 may be secured to top plate 30 and lower surface 60 may be secured to web 36 by an adhesive or any other suitable fastening means. In certain embodiments, support column 34 and web 36 may be of unitary, that is, one-piece, construction. In other embodiments, web 36 is a separate element secured to support column 34 with adhesive or other suitable fastening means.

As depicted in FIGS. 1-3, support columns 34 have a generally cylindrical configuration. Within the scope of the present invention, however, support columns 34 may have a variety of other columnar configurations including oval, pyramidal, cubic, conic, or any other regular geometric shape. In addition to regular shapes, support columns 34 may have an irregular geometric shape. Accordingly, support columns 34 may have a variety of configurations that perform the functions described herein.

In the illustrated embodiment, outsole 28 includes downwardly extending projections 64. Similarly, projections 66 extend downwardly from webs 36. Projections 64, 66 provide the ground-contacting surface for footwear 10. In certain embodiments, a projection 64, 66 is positioned beneath each support column 34. Projections 64, 66 may have any desired cross-sectional shape. As depicted in FIGS. 1-3, projections 64, 66 have a generally cylindrical configuration, matching that of the support columns 34 beneath which they are positioned. As with support columns 34, projections 64, 66 may have a variety of other configurations including oval, pyramidal, cubic, conic, or any other regular geometric shape. In addition to regular shapes, support projections 64, 66 may have an irregular geometric shape. In certain embodiments, projections 64, 66 may be of unitary, that is one-piece, construction with outsole 28 and web 36, respectively. In other embodiments, projections 64, 66 may be separate elements secured to outsole 28 and web 36, respectively, with adhesive or other suitable fastening means.

Support columns 34 serve to attenuate shocks and absorb energy as footwear 10 contacts the ground. The cross-sectional dimension of support columns 34, e.g., the diameter for the cylindrical columns illustrated here, can vary. For example, as illustrated in FIGS. 1-2, the support columns 34 on the periphery of rear support assembly 38 have a larger diameter than those support columns 34 provided in the interior of rear support assembly 38. It is to be appreciated that the size of support columns 34 can be the same or varied within any one support assembly, and can be the same or varied from one support assembly to another.

One or more support columns 34 may include an interior void 68, as illustrated in FIG. 3. Each support column 34 may also include a plurality of physical features, including a smooth surface, circumscribing ridges, one or more circumscribing indentations, one or more circumscribing indentations that include one or more ribs, rings, or indicia, as disclosed in commonly owned U.S. Pat. Nos. 5,353,523 and 5,343,639 to Kilgore et al., the entire disclosures of which are incorporated herein by reference.

In embodiment illustrated in FIGS. 1 and 3, some support columns 34 may include a circumferential rib 70 on exterior surface 62. Circumferential rib 70 may be positioned between a pair of circumferential grooves 72. The compliance of each support column 34 may be altered by repositioning rib 70. For example, each support column 34 may be configured for greatest compliance by positioning rib 70 proximate either upper surface 58 or lower surface 60. The least amount of compliance is achieved by centrally-locating rib 70 along support column 34.

By altering the material of which support columns 34 are made, the number of support columns 34 in each support assembly 32, as well as the compliance of individual support columns 34, an individual may configure footwear 10 to have a desired shock attenuation and energy absorption profile throughout footwear 10.

In other preferred embodiments, as seen in the support assemblies 32 in forefoot portion 16 of footwear 10 in FIG. 1, support columns 34 include a sole circumferential groove 72 on exterior surface 62. The compliance of each support column 34 may be altered by repositioning groove 72. For example, support columns 34 may be configured for a desired compliance by positioning groove 72 adjacent either upper surface 58 or lower surface 60. The least amount of compliance is achieved by centrally-locating groove 72. By altering the compliance of support columns 34, footwear 10 can be configured differently to have proper shock attenuation and energy absorption for individuals of different weights, for example. Altering the cross-sectional dimension, e.g., diameter in the case of a cylindrical support column, can also alter the performance characteristic of a particular support column 34.

As noted above, each support assembly 32 includes a plurality of support columns 34. In certain embodiments, each support assembly 32 includes at least six (6) support columns 34.

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:

an upper; and a sole assembly secured to the upper and comprising:

an upper plate; and a plurality of support assemblies, each support assembly including a web spaced from the upper plate and a plurality of elastomeric support columns extending between the upper plate and the web, each elastomeric support column being secured to the web; and an outsole secured to at least one of the support assemblies.

2. The article of footwear of claim 1, wherein the sole assembly includes a lateral support assembly on a lateral side of the upper plate and a medial support assembly on a medial side of the upper plate and spaced from the lateral support assembly.

3. The article of footwear of claim 1, further comprising a longitudinal gap extending between a medially positioned support assembly and a laterally positioned support assembly.

4. The article of footwear of claim 1, further comprising a transverse gap extending between a rear support assembly positioned in a heel portion of the upper plate and a midfoot support assembly positioned forwardly of the rear support assembly.

5. The article of footwear of claim 1, wherein a web in a support assembly in a forefoot portion of the upper plate includes a slit that extends forwardly into the support assembly from a rear edge thereof.

6. The article of footwear of claim 1, wherein the sole assembly comprises:

a heel support assembly;

a midfoot support assembly spaced forwardly from the heel support assembly;

a first forefoot support assembly spaced forwardly from the midfoot support assembly and positioned on a lateral side of the footwear;

a second forefoot support assembly spaced forwardly from the midfoot support assembly and medially from the first forefoot support assembly; and a third forefoot support assembly spaced forwardly of the first and second forefoot support assemblies.

7. The article of footwear of claim 1, wherein an exterior surface of at least one elastomeric support column includes a circumferential groove.

8. The article of footwear of claim 1, wherein an exterior surface of at least one elastomeric support column includes a pair of circumferential grooves and a circumferential rib positioned between the circumferential grooves.

9. The article of footwear of claim 1, wherein at least one elastomeric support column includes a central void.

10. The article of footwear of claim 1, wherein at least one elastomeric support column is formed of one of rubber, polyurethane foam, microcellular elastomeric foams, or EVA foam.

11. The article of footwear of claim 1, wherein the outsole is secured to a support assembly positioned in a heel portion of the sole assembly.

12. The article of footwear of claim 11, wherein the outsole is secured to the web of the support assembly positioned in the heel portion of the sole assembly.

13. The article of footwear of claim 1, wherein the web and support columns of at least one support assembly are of unitary construction.

14. The article of footwear of claim 1, wherein a plurality of projections extend outwardly from a lower surface of at least one web.

15. The article of footwear of claim 14, wherein each projection is positioned beneath a corresponding support column.

16. The article of footwear of claim 1, wherein each support assembly includes at least six support columns.

17. An article of footwear comprising, in combination:

an upper; and a sole assembly secured to the upper and comprising:

an upper plate; and a plurality of support assemblies, each support assembly including a web spaced from the upper plate and a plurality of elastomeric support columns extending between the upper plate and the web, and each support assembly spaced from other adjacent support assemblies by a gap, each elastomeric support column being secured to the web; and an outsole secured to at least one of the support assemblies.

18. The article of footwear of claim 17, wherein the outsole is secured to a support assembly in a heel portion of the sole assembly.

19. The article of footwear of claim 17, wherein an exterior surface of at least one elastomeric support column includes a circumferential groove.

20. The article of footwear of claim 17, wherein an exterior surface of at least one elastomeric support column includes a pair of circumferential grooves and a circumferential rib positioned between the circumferential grooves.

21. The article of footwear of claim 17, wherein at least one elastomeric support column includes a central void.

22. The article of footwear of claim 17, wherein at least one elastomeric support column is formed of one of rubber, polyurethane foam, microcellular elastomeric foams, and EVA foam.

23. The article of footwear of claim 17, wherein each support assembly includes at least six elastomeric support columns.

24. An article of footwear comprising, in combination:

an upper; and a sole assembly secured to the upper and comprising:

an upper plate; and a heel support assembly;

a midfoot support assembly spaced forwardly from the heel support assembly;

a lateral support assembly spaced forwardly from the midfoot support assembly on a lateral side of the footwear;

a medial support assembly spaced forwardly from the midfoot support assembly on a medial side of the footwear; and a forefoot support assembly spaced forwardly of the lateral and medial support assemblies;

wherein each support assembly includes a web spaced from the upper plate and a plurality of support columns extending between the upper plate and the web; and an outsole secured to the heel support assembly.

* * * * *